US005384006A

United States Patent [19]

Meyer

[11] Patent Number: 5,384,006

[45] Date of Patent: Jan. 24, 1995

[54] LABELING APPARATUS WITH CLUTCHES TO BLOCK LABEL REMOVAL

[75] Inventor: Harry Meyer, Pinneberg, Germany

[73] Assignee: Anker-Maschinenbau GmbH, Hamburg, Germany

[21] Appl. No.: 165,087

[22] Filed: Dec. 10, 1993

[30] Foreign Application Priority Data

Dec. 16, 1992 [DE] Germany ..... 4242489

[51] Int. Cl.[6] ..... B65C 9/00

[52] U.S. Cl. ..... 156/566; 156/567; 156/571; 156/363

[58] Field of Search ..... 156/566, 567, 571, 356, 156/357, 570, 573, DIG. 29, DIG. 30, 363; 118/220, 231, 236, 240

[56] References Cited

U.S. PATENT DOCUMENTS 3,735,731 5/1973 Tavernier ..... 118/220
4,127,435 11/1978 Zodrow ..... 156/DIG. 29 X
4,361,460 11/1982 Kronseder ..... 118/231 X

*Primary Examiner*—David A. Simmons
*Assistant Examiner*—James J. Engel
*Attorney, Agent, or Firm*—Walter C. Farley

[57] ABSTRACT

Labeling equipment has a support rotatably driven about a central shaft and above a stationary bench, the support carrying label shafts pivoted by gear assemblies so that curved label plates on the label shafts are glue-coated over their full area by rolling off a glue roller when the support is rotating, removing labels from a label box and transferring the labels to a label transfer device. The gear assemblies each have a gear segment pivotably resting on a gear assembly shaft borne in the support and meshing with a pinion of the label shaft, the gear segment being pivotably driven by a cam follower moving along a cam curve in the bench. Clutches are coupled in a predetermined angular position of the support to disengage individual label plates from their constrained motion to block label removal. The cam follower is carried by a pivoting arm on the gear assembly shaft, the arm being engageable by means of a clutch with the gear segment.

9 Claims, 3 Drawing Sheets

LABELING APPARATUS WITH CLUTCHES TO BLOCK LABEL REMOVAL

FIELD OF THE INVENTION

This invention relates to labeling equipment having clutch means to control the transfer of a label to prevent malfunction in the event of a gap in a supply of receptacles or the like to which the labels are being applied.

BACKGROUND OF THE INVENTION

Labeling equipment of this general type removes labels from a label supply box by means of label plates rotatably carried by a rotating support. After each plate has been glue-coated, the plate removes the foremost label from the supply box by a rolling motion and thereupon transfers the label to a label conveyor from which the labels then are again transferred and adhered onto containers such as bottles. Problems arise in this process, particularly when gaps are present in the flow of receptacles to be labeled because in that event the label conveyor presents labels lacking corresponding receptacles. As a rule the labeling equipment is driven continuously and therefore cannot be stopped. Thus, excess labels accumulate and operation is interfered with.

German patent document 30 44 879 C2, which is hereby incorporated by reference, discloses labeling equipment of this general type which circumvents this problem by blocking removal of individual labels in continuously running labeling equipment. Clutches are provided which, when a receptacle gap occurs, disengage corresponding label plates from their constrained motion, so that these plates do not carry out their rolling motion at the label box and accordingly do not remove any label.

The label shafts of this known design are split and the clutches are between the label-shaft segments.

This design has certain drawbacks because of additional and costly couplings which are needed on the gear assembly and which furthermore present control difficulties.

SUMMARY OF THE INVENTION

An object of the present invention is to provide labeling equipment of the kind discussed above which solves the problem of label blocking by simple clutch means.

In accordance with the invention, the clutches are between cam followers and the segments. Upon disengagement, the cam followers are able to follow the cam, but the gear segments are free, and as a result the label shafts and hence the label plates can be motionless. The clutches are in gear assemblies actuating the label shafts, and this feature substantially simplifies the design. The label shafts may be integral. Unlike the known design, that of the invention does not require control lines in the upper zone of the labeling equipment. Instead, as described below, clutch control is more simply carried out from a bench on which the apparatus is supported.

A stop easily manufactured in a conventional manner and non-rotatably affixed to the bench can be made to engage or disengage the gear segment from the path of motion of the segment. Once the stop engages the gear segment, it exerts a torque on it so that an overload is applied to the clutch which then disengages by itself. Clutch actuation takes place for all label-plate clutches using only one non-rotational stop. The design of the labeling equipment is much simplified thereby. The need for control lines to all clutches is eliminated.

The stop can be designed so that, in its engaged position, it is in the path of motion of the gear segments when the support is revolving and thus strikes the gear segments out of clutch engagement. The stop thereby merely prevents rotation of the particular gear segment caused by the cam shape and makes the clutch disengage. As a result, engagement loads between stop and gear segment are lower. The engagement loads between the stop and the outwardly pivoting contacting lever of the gear segment can be advantageously reduced further, especially by forming and shaping the cam that controls the gear segment such that the contacting lever first moves precisely radially to the central axis into the stop's range of engagement and thereupon, while engaged with that stop, it gradually exerts an outward pressure, causing the clutch to disengage. This allows complete avoidance of any impact loads.

As already known from the state of the art, when the clutch is not engaged, the gear segment is non-rotatably coupled to the support so that the label plates are reliably held in an angular position in which contact with the label box when moving past this label box is prevented.

Further features of the invention provide an especially simple design offering high operational reliability.

The simple clutch pin design of the invention allows a self-disengaging clutch for which the spring-loaded clutch pin also reenters the recess as soon as the pivot arm and the gear segment are once more in the clutch engagement-position at the corresponding peripheral site of the support.

The invention offers a very simple clutch wherein a clutch pin couples the gear segment either with the pivot arm or with the support, so that the label plates either are coupled into their constrained motion or are non-rotatably joined to the support.

The labeling equipment advantageously comprises a stop which for blocking purposes may be made to engage the gear segments and which in case of overload actuates the self-disengaging clutch. However, problems could arise if the stop were still disengaged as the gear segment comes into position, for instance if the stop were made to engage only when the gear segment already is in the engagement range. Material-destructive forces might be generated. It would be just as much a drawback if the stop were made to disengage while the gear segment were still within the engagement range because in such a case clutch actuation would be consummated only by half, and this condition can lead to faulty coupling and therefore also to material destruction. Therefore the control system for the stop causes it to be locked while a gear segment is in the engagement range of the stop. This control system therefore can only make the stop engage or disengage when its engagement range is without a gear segment. This feature ensures that clutch actuation either takes place completely from beginning to end or not at all.

The locking of this control system can take place in various manners as a function of the presence of gear segments in the stop's engagement range. Illustratively, the presence of gear segments may be monitored by proximity sensors, or the position of the gear segment can be inferred from the rotational position of the rotating support. However, additional devices would be required which would make the design more complex. In accordance with the invention, the control system is able on its own to ascertain when to lock and when it may be actuated. For that purpose it need only ascertain the loading on the stop. If this stop engages a gear segment, then it will be loaded. This is a signal to the control system that it must lock. Time-delayed locking must be averted. Also the design should be as simple as possible. Those designs therefore are preferred in which the control system is mechanically self-locking when there is a mechanical load.

BRIEF DESCRIPTION OF THE DRAWINGS

The invention is shown schematically and illustratively in the accompanying drawings wherein.

DESCRIPTION OF THE PREFERRED EMBODIMENT

Figure 1:
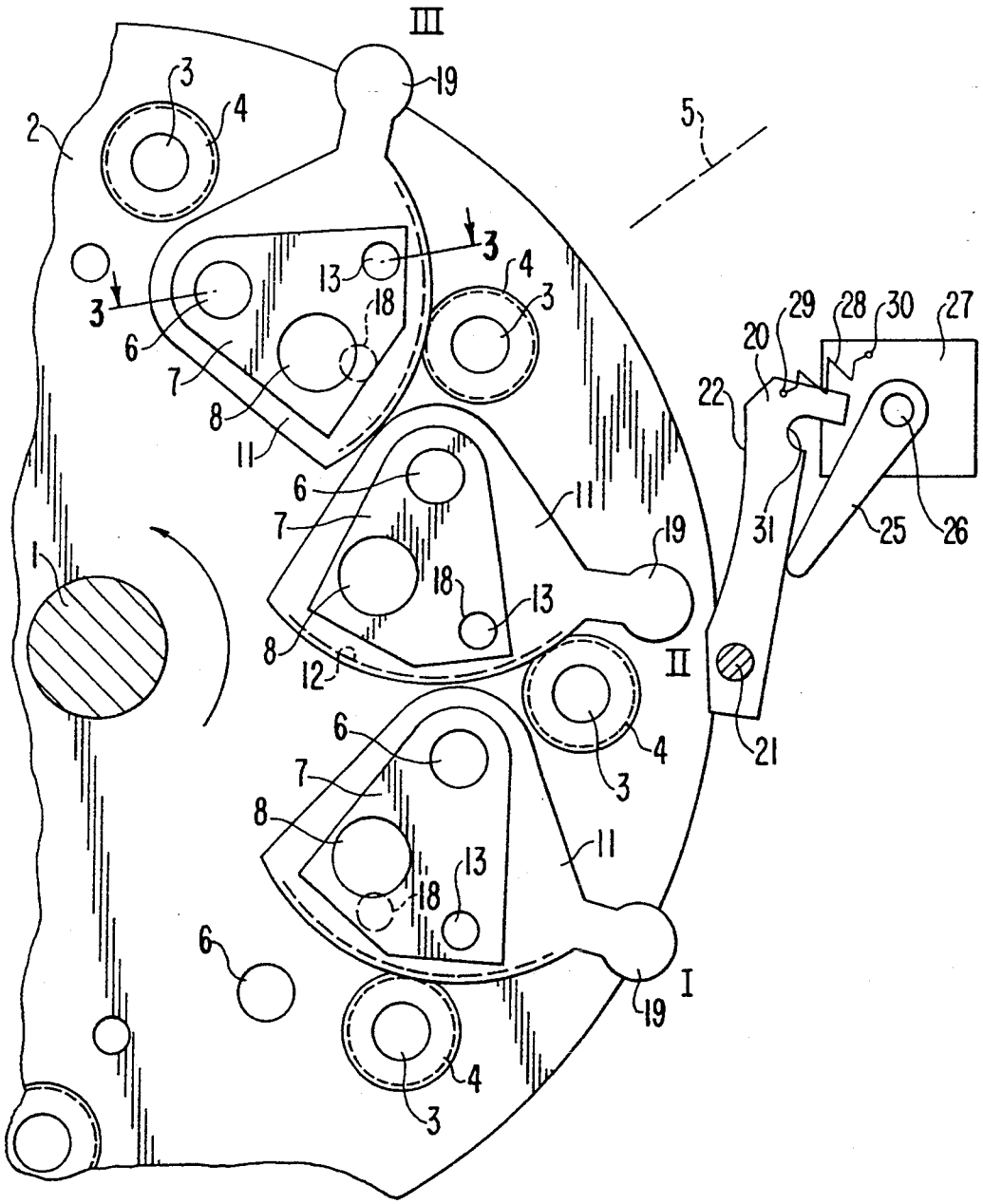
FIG. 1 is a bottom plan view, partially in section along line 1—1 of FIG. 3, showing a support with several gear assemblies when the stop is disengaged.

FIG. 1 is a bottom plan view of a disk-like support 2 rotatably driven by drive means, not shown, in the direction of the arrow about a central shaft 1. Several label shafts 3, each fitted with a pinion 4 underneath support 2, are rotatably supported with their axes parallel with central shaft 1 and disposed at the same radius from shaft 1, the shafts 3 being circumferentially equidistant from one another.

Figure 3:
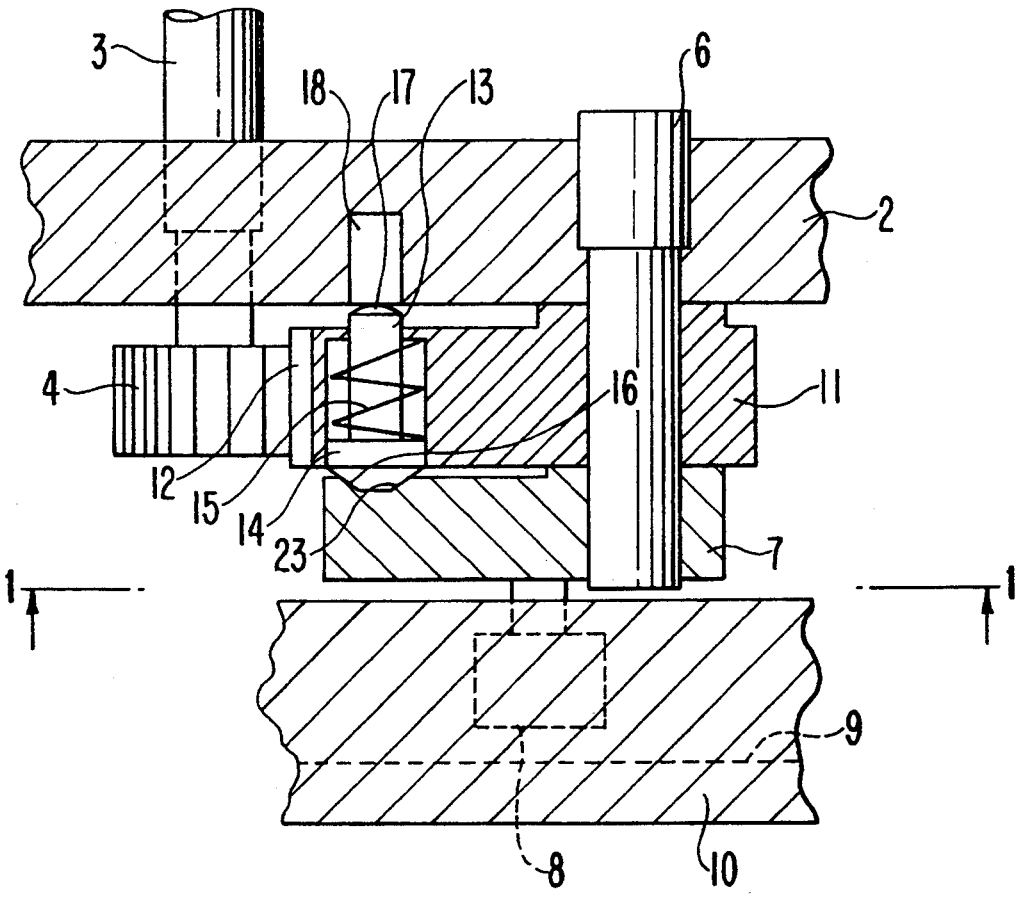
FIG. 3 is a side elevation, in section, along line 3—3 of FIG. 1, of a gear assembly in accordance with the invention.

As seen in FIG. 3, the bearing site of a label shaft 3 is located behind the sectional plane. Each label shaft 3 projects upwardly beyond support 2 and the upper ends thereof support label plates, not shown, arranged, if desired, essentially as shown in FIG. 1 of German patent document 30 44 879 C2. When a label shaft 3 is caused to go through a pivoting motion, the associated label plate is glue-coated over its entire surface at a glue roll and then, at a later station, rolls on the foremost label of a label supply box to remove a label therefrom and to transfer this label to a label conveyor to be transferred to a receptacle.

The location of the label box with the axis along which labels are advanced is indicated in FIG. 1 at 5.

A gear assembly is associated with each label shaft 3 underneath the support 2 in order to achieve the rotation of the label shafts 3 which causes the required pivoting of the label plates, and this gear assembly will now be described.

A gear assembly shaft 6 is mounted in support 2 parallel with each label shaft 3 and carries a pivotable arm 7. Each pivotable arm 7 carries a cam follower in the form of a roller 8 having an axis parallel to gear assembly shaft 6. Roller 8 runs in a cam in the shape of a groove 9 formed in a bench 10 which is non-rotatably fixed under support 2 (outside the sectional plane of FIG. 3). The cam formed by groove 9 may be designed similarly to that shown in FIG. 4 of German patent document 30 44 879 C2 and, because of its eccentricity, causes to-and-fro pivoting of the pivotable arm 7 about gear assembly shaft 6 when the support is revolving.

A toothed gear segment 11 is rotatably supported on gear assembly shaft 6 and can be coupled by a clutch to pivotable arm 7 for common pivoting motion therewith. Teeth 12 of segment 11, shown in dashed lines, mesh with a pinion 4 of the associated label shaft 3 and thereby causes rotation of the label shaft 3 to pivot the label plate carried by the label shaft when support 2 is revolving.

In a variation from the illustrated embodiment, and in the manner shown in the German patent document 30 44 879 C2, the gear assembly with gear segment 11 and pivotable arm 7 may not rest on a separate gear assembly shaft 6 but instead on the next label shaft.

A disengageable clutch is between gear segment 11 and pivoting arm 7 to allow these components to disengage or to engage in predetermined angular positions. As shown by FIG. 3, a clutch pin 13 is supported in a longitudinally displaceable manner in gear segment 11 with its longitudinal axis parallel with gear assembly shaft 6. As shown by this Figure, the upper portion of clutch pin 13 rests directly in gear segment 11 and the lower end, having an enlarged head 14, is slidably received in a mating borehole formed in gear segment 11. The borehole also receives a helical spring 15, one end of which abuts the inner end of the borehole in gear segment 11 and the other end of which presses against head 14 of the clutch pin 13, urging the head downwardly as shown in FIG. 3. The lower end of head 14 is formed into a cone 16 which, as shown in FIG. 3, enters a conical recess 23 in the upper surface of pivoting arm 7.

Accordingly, for the engaged position shown by FIG. 3, pivoting arm 7 and gear segment 11 are coupled together by cone 16 engaging recess 23 to achieve common pivoting motion.

Clutch pin 13 has a rounded tip 17 at its upper end and is located precisely underneath the radius of centers of a plurality of boreholes 18 in support 2, shown sectionally in FIG. 3 outside the sectional plane, which the clutch pin can enter when it is angularly aligned with one of the boreholes and when the clutch pin is raised counter to the force of helical spring 15. Boreholes 18 and clutch pins 13 are shown for several gear assemblies in FIG. 1.

FIG. 1 shows three complete gear assemblies of which the positions at the circumference of the support 2 are denoted by I, II and III. In these three gear assemblies, the clutches are engaged such that the cone 16 of head 14 of each clutch pin 13 enters the associated conical recess 23 in a pivoting arm 7. Therefore, each gear segment 11 and pivoting arm 7 are jointly pivoted by the roller 8 entering the groove 9.

This pivoting motion is shown by the different positions I, II and III of FIG. 1. By comparing therein the particular positions of roller 8 with the adjacent dashed revolving line following the centers of gear assembly shafts 6, it will be observed that the groove 9 (not shown in FIG. 1) at position I is radially farther out, relative to axle 1, than in position II in which it is far more inward. In position III the groove 9 is again moved outward. Thereby the shown pivoting motion of the gear segments 11 is achieved, wherein the gear segment in position II pivots somewhat backward relative to the position I and the rotation of the support 2, and somewhat forward in position III. Because of the transmission ratio between gear segment 11 and pinion 4 of the associated label shaft 3, pronounced pivoting of the associated label plates takes place to generate the roll-off motion of the label plates at the foremost label at the label box located at 5.

An outward-pointing contacting lever 19 is attached to each gear segment 11 and, as shown in FIG. 1, the levers 19 of all three segments are out of engagement while moving past an outwardly pivoted stop 20 which is pivotably driven by a shaft 21 affixed to the bench 10 mounted underneath support 2.

Figure 2:
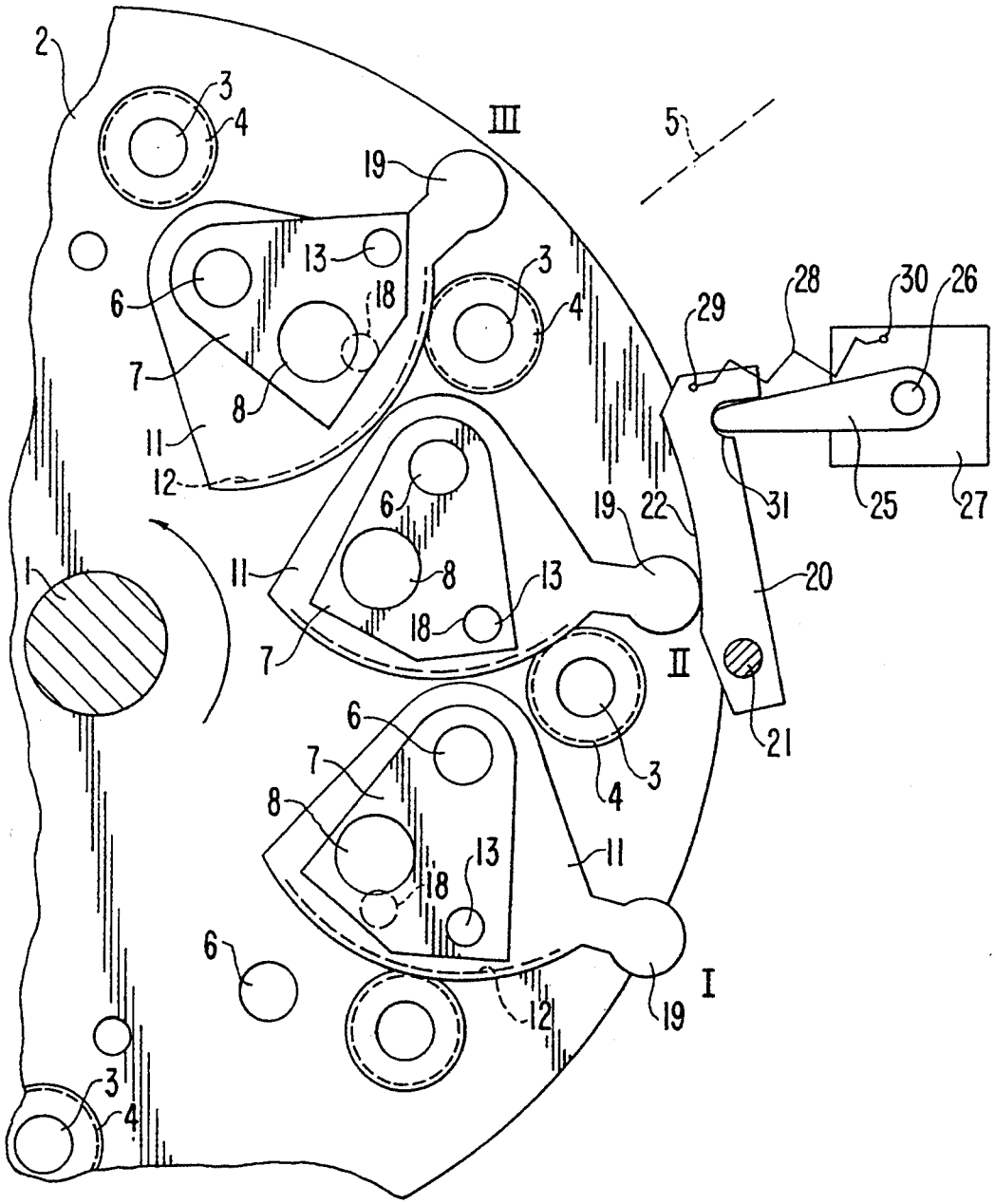
FIG. 2 is a sectional view similar to FIG. 1 with the stop engaged.

FIG. 2 shows the equipment of FIG. 1 in the same gear assembly rotational location of the gear assemblies in the positions I, II and III. The sole difference is that the stop 20 has been pivoted into engagement as a result of which its facing curved stop surface 22 is essentially coaxial with central shaft 1.

The backward pivoting motion of the contacting levers 19 carried by gear segments 11 and already discussed in relation to FIG. 1 takes place unhampered between the positions I and II. However, in the subsequent forward pivoting motion from II to III shown in FIG. 1, the contacting lever 19 when in position II of FIG. 2 comes to rest against stop surface 22 and blocks further forward pivoting motion of the gear segment. The associated pivoting arm 7 on the other hand is constrained to be pivoted further because its roller 8 is being guided in groove 9 attached to bench 10. Clutch pin 13 is thereby lifted out of conical engagement with pivoting arm 7 and the clutch shown in FIG. 3 disengages, allowing the pivoting arm 7 to be displaced further while gear segment 11 is held motionless.

The cam shape of groove 9, which together with roller 8 pivots the gear segment 11 and hence the contacting lever 19, is selected in such a way that, when a contacting lever 19 runs onto stop surface 22 of stop 20, this contacting lever 19 is positioned at a precise radius relative to central shaft 1. Because stop surface 22 is also positioned at a precise radius relative to the central shaft 1, contacting lever 19 of the preferred embodiment first moves effortlessly, while making slight contact, parallel with stop surface 22. Only after contacting lever 19 has moved some distance along stop surface 22 will groove 9 constrain, by its shape, an outward pivoting motion of gear segment 11 and thus force contacting lever 19 against the stop surface 22 until the resulting forces cause the clutch to disengage. As a result, a gradual and shock-free force buildup takes place when disengaging the clutch to ensure long-term, problem-free operation.

As shown by FIGS. 1 and 2, at the time when the contacting lever 19 comes into engagement with the stop surface 22, clutch pin 13 will be in position II precisely underneath the associated borehole 18 in support 2. It is exactly at that time that the clutch disengages. In the process, clutch pin 13 is lifted against the force of spring 15 and thereby is made to enter the borehole 18.

During the ensuing revolving motion of support 2, clutch pin 13 remains engaged in borehole 18 because pivoting arm 7 and gear segment 11 reach a relative angular position only when position II is arrived at again for which a recess 23 in gear segment 7 will be located underneath cone 16 of clutch pin 13. Thereupon clutch pin 13 is forced down by spring 15 into clutch engagement and is extracted from borehole 18 of support 2.

If at that time stop 20 is disengaged, as shown in the position of FIG. 1, then the clutch remains in the position shown in FIG. 3 and couples the pivoting arm 7 and the gear segment 11 for joint further motion as shown in FIG. 1.

On the other hand, if stop 20 remains in the locked position of FIG. 2, then it is disengaged at once. Thus, cone 16 again forces clutch pin 13 upward into the borehole 18 and the gear assembly keeps running while being disengaged as shown in FIG. 2, gear segment 11 remaining non-rotatably locked to the support 2.

Stop 20 can be controlled manually or automatically by means of a sensor monitoring for gaps the flow of receptacles to be labeled.

An additional control device, discussed hereinafter, can ensure the adjustment of stop 20 into the engaged position of FIG. 1 or the disengaged position of FIG. 2 by implementing a pivoting motion by means of shaft 21, although this is not a preferred embodiment.

If this control device were to pivot stop 20 out of the position of FIG. 1 into the position of FIG. 2 when contacting lever 19 located in the engagement range of stop 20 shown in position II is in the position shown in FIGS. 1 and 2, then various mechanical parts might be overloaded because the engagement would take place too late and at the wrong relative angle. In particular the clutch might be overloaded. Again, care must be taken that for the contacting lever 19 engaged with the also engaged stop 20 of FIG. 2, this stop 20 is not disengaged. In that case the clutch engagement would be interrupted mid-way. As shown by FIG. 3, a position might result for which the clutch pin 13 would assume an undefined intermediate position. The result of clutch engagement then would be random. Moreover the clutch might be damaged.

To forestall such eventualities, the control device for stop 20 is designed in such a way that it only carries out the pivoting motion of stop 20 when its engagement range is free of any contacting lever 19. As a result, clutch engagement always takes place completely from beginning to end and with proper application of force.

For that purpose, the control device driving stop 20 may monitor in an arbitrary manner the presence of a contacting lever 19 or of a gear segment 11 in the engagement range of stop 20. Illustratively, optical light barriers or inductive proximity sensors may be used for that purpose. Furthermore the control device may be coupled through a gear assembly with the rotatably driven support 2.

Stop 20 or its shaft 21 may be coupled to a force sensor for ascertaining whether a contact lever 19 is exerting forces on the stop 20. This is a reliable sign of engagement between a contacting lever 19 and stop 20. If such force loading is detected, the control device will be blocked.

In a preferred embodiment shown in FIGS. 1 and 2, stop 20 is freely pivotable around shaft 21 which is fixed on bench 10. A shift lever 25 is fixed on a shaft 26 driven by a motor 27 (which may be mounted on bench 10) between the positions of shift lever 25 shown in FIGS. 1 and 2.

Stop 20 is biased outwardly by spring 28 mounted on a pin 29 on stop 20 and a pin 30 on motor 27.

On the back side of stop 20 near its free end, there is a notch 31 which the free end of shift lever 25 can engage as shown in FIG. 2. In the position of FIG. 2, shift lever 25 engages notch 31. By the force of spring 28, stop 20 is fixedly secured in this position and is strongly held against any radially outward force against stop 20 by an advancing contacting lever 19. Stop 20 therefore can withstand the contacting force of contact lever 19 attempting to disengage the clutch between parts 7 and 11.

If stop 20 is to be shifted into the disengagement position of FIG. 1, shift lever 25 is turned by motor 27 to its FIG. 1 position. Motor 27 must be selected to have a relatively weak driving force sufficient to overcome the force of spring 28 and to move shift lever out of notch 31. However, the force of motor 27 must be able to do this only if stop 20 is free of any contacting forces imposed by one of contact levers 19.

If in the position of FIG. 2 a contact lever 19 is pressing against surface 22 of stop 20, motor 27 is not able to remove shift lever 25 out of notch 31. Thus, motor 27 is blocked if stop 20 is contacted by a contacting lever 19.

If motor 27 is actuated to move the shift lever from the position of FIG. 1 to the position of FIG. 2, this movement is also possible only if stop 20 is free of any additional forces. Only in the absence of such forces can the weak force of motor 27 turn shift lever 25 around from the position of FIG. 1 into the position of FIG. 2, thereby pushing stop 20 against the force of spring 28 to cause the distal end of shift lever 25 to engage notch 31.

Again, this movement cannot take place if a contacting lever 19 is in the way of stop 20. The weak force of motor 27 then cannot overcome the outwardly directed force of contacting lever 19 and cannot disengage the clutch between parts 7 and 11.

Thus the shown means for moving stop 20 is able to move, either way, only if it is not engaged by any of the contact levers 19.

Variations within the scope of the invention are possible relative to the embodiment of the clutch as shown in FIG. 3. Under some circumstances, the locking of gear segment 11 to the bench 2 may be dropped for the disengaged position. Instead of the design with clutch pin 13, other clutch designs are possible in which, upon overload, they disengage and where called for also implement locking of gear segment 11 to support 2, illustratively using spring-loaded levers resting on gear segment 11 and comprising removable engaging means into pivoting arm 7 and where called for engaging means into support 2.

Stop 20 shown in FIGS. 1 and 2, serving to disengage the clutch between pivoting arm 7 and gear segment 11, is designed in such a way that it only prevents rotation of gear segment 11 about gear-assembly shaft 6 resulting from the pivoting motion and generated by roller 18 when following groove 9.

However, clutch disengagement also can be produced in another manner, for instance by moving a blocking stop instead of stop 20 into the revolving path of contacting levers 19 caused by the rotation of the support 2 in such a way that the contacting levers frontally impact the stop and are pivoted back. Such a variation makes it possible, just as the above one, to carry out locking of gear segments 11 to support 2 simultaneously with the disengagement of the clutch.

What is claimed is:

1. In a labeling apparatus having a rotatably driven support (2) rotating about a longitudinal axis of a central shaft mounted on a stationary bench, a plurality of label shafts having axes parallel with said central shaft rotatably carried by said support, curved label plates fixed to said label shafts and positioned for glue coating during rotation of said support, for removing labels from a label supply box and for transferring said labels to a label transfer device, a substantially continuous cam on said bench and means for pivoting said label shafts relative to said support as said support rotates, the improvement wherein each said means for pivoting a label shaft includes a pinion (4) on said label shaft;

cam follower means (8) for engaging and following said cam;

a gear assembly shaft carried by said support (2), said gear assembly shaft having a longitudinal axis;

a pivotable arm (7) attached to said cam follower means and pivotable about said longitudinal axis of said gear assembly shaft (6);

a drive gear segment (11) meshing with said pinion and pivotable about said axis of said gear assembly shaft (6);

clutch means (13, 15, 16, 23) for selectively coupling said drive gear segment to said pivotable arm to cause said drive gear segment to pivot with said arm, said pinion and label shaft being driven thereby.

2. An apparatus according to claim 1 wherein said clutch means (16, 23) is self-disengaging in response to overload, said apparatus further comprising a stop (20) mounted on said bench (10) before said label supply box (5) in the sense of rotation of said support (2), said stop having a stop surface (22) movable into the path of motion of said drive gear segments (11) to cause an overload and disengage said clutch means.

3. An apparatus according to claim 2 wherein said stop surface (22) is curved and substantially coaxial with said central shaft 1 and each of said gear segments (11) includes an outwardly extending contact lever (19) for contacting said stop surface (22).

4. An apparatus according to claim 2 and including a control means for selectively engaging or disengaging said stop (20), said control means and said stop being arranged so that said control means is prevented from changing its engagement status with said stop when a gear segment (11) is present in a range of engagement with said stop surface (22).

5. An apparatus according to claim 4 wherein said preventing of disengagement of said control means includes said gear segments (11) applying force to said stop surface (22).

6. An apparatus according to claim 1 wherein said clutch means (16, 13) non-rotatively couples said gear segment (11) to said support (2) when said gear segment (11) is disengaged from said pivotable arm (7).

7. An apparatus according to claim 1 wherein said clutch means includes a clutch pin (13) having a longitudinal axis parallel to said central shaft, said pin being mounted on one of said gear segment and said pivotable arm (7, 11) to be coupled, said clutch pin (13) being longitudinally movable to engage a recess (23) of the other of said gear segment and said pivotable arm.

8. An apparatus according to claim 7 wherein said clutch pin (13) is mounted in said gear segment (11) and is selectively movable to engage one of a recess (23) in said pivoting arm (7) and a recess (18) in said support (2).

9. An apparatus according to claim 7 wherein said clutch pin (13) is spring-urged to press against said other of said gear segment and said pivotable arm, said other of said gear segment and said pivotable arm having a beveled recess (23) to receive an end of said pin.

* * * * *